US006044339A

United States Patent [19]

Zack et al.

[11] Patent Number: 6,044,339

[45] Date of Patent: Mar. 28, 2000

[54] REDUCED REAL-TIME PROCESSING IN STOCHASTIC CELP ENCODING

[75] Inventors: Rafael Zack, Kiryat Ono; Shimon Dahan, Petach Tikva, both of Israel

[73] Assignee: DSPC Israel Ltd., Givat Shmuel, Israel

[21] Appl. No.: 08/982,426

[22] Filed: Dec. 2, 1997

[51] Int. Cl.[7] ..... G10L 19/10

[52] U.S. Cl. ..... 704/223; 704/218

[58] Field of Search ..... 704/223, 219, 704/218, 202, 220, 221, 200, 262, 263, 264

[56] References Cited

U.S. PATENT DOCUMENTS

| | | | |
|---|---|---|---|
| 4,868,867 | 9/1989 | Davidson et al. | 704/230 |
| 4,899,385 | 2/1990 | Ketchum et al. | 704/223 |
| 4,910,781 | 3/1990 | Ketchum et al. | 704/223 |
| 5,187,745 | 2/1993 | Yip et al. | 704/219 |
| 5,327,520 | 7/1994 | Chen | 704/219 |
| 5,414,796 | 5/1995 | Jacobs et al. . | |
| 5,513,297 | 4/1996 | Kleijn et al. | 704/223 |

*Primary Examiner*—Richemond Dorvil
*Attorney, Agent, or Firm*—Mark M. Friedman

[57] ABSTRACT

Methods are presented for reducing the processing required for CELP speech encoders which have multiple fixed stochastic codebook subframes corresponding to a single adaptive codebook subframe. The search for the optimum excitation vector in the fixed stochastic codebook requires calculating terms involving correlation of the target speech sample and the fixed stochastic codebook excitation vector as well as energy terms involving only the fixed stochastic codebook excitation vector, and for this class of CELP encoders it is possible to simplify the calculations to reduce their complexity and to make advantageous use of an adaptive energy lookup table. In addition, linear interpolation may be employed to estimate values for the adaptive energy lookup table and further reduce the computational burden.

9 Claims, 4 Drawing Sheets

40 42 44

| index | convolution | energy |
|---|---|---|
| 1 | $\mathbf{H}c_1$ | $\lVert \mathbf{H}c_1 \rVert^2$ |
| 2 | $\mathbf{H}c_2$ | $\lVert \mathbf{H}c_2 \rVert^2$ |
| ... | ... | ... |
| $N$ | $\mathbf{H}c_N$ | $\lVert \mathbf{H}c_N \rVert^2$ |

40 46

| index | normalized convolution |
|---|---|
| 1 | $\mathbf{H}c_1 / \lVert \mathbf{H}c_1 \rVert^2$ |
| 2 | $\mathbf{H}c_2 / \lVert \mathbf{H}c_2 \rVert^2$ |
| ... | ... |
| $N$ | $\mathbf{H}c_N / \lVert \mathbf{H}c_N \rVert^2$ |

FIG. 4.

REDUCED REAL-TIME PROCESSING IN STOCHASTIC CELP ENCODING

FIELD AND BACKGROUND OF THE INVENTION

The present invention relates to improvements in a method for digital compression of speech and other audio signals, and, more particularly, to improvements in stochastic code excited linear predictive encoding.

Code Excited Linear Predictive encoding (CELP) is well-known as a means of digitally compressing speech and other audio signals for improving the efficiency of communication. Using CELP, the speech to be transmitted, referred to hereinafter as the "target speech," is analyzed by an encoder to determine a set of parameters and indices in a codebook of excitation vectors which best characterize the actual target speech waveform. It is these parameters and codebook indices which are transmitted, rather than signals representing the waveform of the target speech itself. Doing so realizes substantial savings in transmission costs, since the parameters and codebook indices require far less bandwidth to transmit than unprocessed speech. At the other end of the transmission, a compatible decoder synthesizes waveforms according to the received parameters and codebook indices, and thereby reconstructs the target speech. The present application uses the term "speech" to denote any analogs signals over a spectrum up to 4 KHz.

In order to perform the analysis by which the codebook indices and parameters are determined, the original analog target speech waveform is first digitally sampled according to the Nyquist criterion at a minimum of twice the maximum frequency of the desired spectrum. For example, to attain a commonly-found 4 KHz maximum frequency, the sampling rate must be at least 8 KHz. The speech samples are then divided into sequential time frames. A typical frame at an 8 KHz sampling rate would contain 160 samples, corresponding to a 20 msec segment of speech. The frames are next divided into subframes. The codebook excitation vectors, represent Gaussian noise samples; their vector size corresponds to the number of samples in a subframe. Hereinafter, N denotes the number of excitation vectors in a codebook. Typically, N is of the order of 128. When the appropriate excitation vector is selected from such a codebook and input into a weighted synthesis filter which has been set with suitable linear predictive coefficients (LPC's), the output of the weighted synthesis filter is a waveform which can closely approximate a segment of the speech waveform. It is the index of this excitation vector in the codebook which is transmitted along with the LPC's and associated parameters to compress the speech of that segment. All of the filters used in such an encoder are linear filters, and therefore when reference is made to a filter in the present application, it will be understood that it is a linear filter.

A crucial portion of the analysis performed by the encoder, therefore, is a search through the codebook to find the optimum excitation vector to use. This requires testing all the excitation vectors one at a time, by sending each excitation vector to the input of the weighted synthesis filter, and then comparing the output of the weighted synthesis filter to the sampled target speech waveform. The excitation vector which yields the closest fit to the target speech segment is selected. This excitation vector is simply and easily referenced by its index in the codebook and therefore specifying i is equivalent to specifying $c_i$.

FIG. 1, to which reference is now briefly made, illustrates conceptually the prior art method for selecting the optimum excitation vector from a codebook. Each excitation vector in the codebook is referenced by an index i, $c_i$ is thus the excitation vector corresponding to the index i. The target speech sample 14 t(n) is processed by a weighting filter 16 which is a function of the LPC, to yield the weighted target speech sample $t_w(n)$. Each excitation vector $c_i$ of the codebook 10 is processed by the weighted synthesis filter 12 to result in a weighted synthesized speech sediment $S_i(n)$, Which is compared against weighted target speech sample by comparator 18, Whose output is the difference $t_w(n)-S_i(n)$, which is the error vector E(n). Error computation 20 computes the mean squared error over the error vector for each codebook index i. The index i whose $c_i$ has minimal mean squared error is the selected index.

In practice, the computation for selecting the codebook index is different from the conceptual procedure illustrated in FIG. 1, although it is mathematically equivalent. The impulse response of the weighted synthesis filter is a matrix denoted by H, which may be selected, for example, to be the truncated impulse response of the weighted synthesis filter. The matrix H will be changed from one adaptive codebook subframe to the next. As is known in the art, the optimum excitation vector $c_i$ selected by the process illustrated in FIG. 1 has the property that there is a selection function which is maximum over the set of excitation vectors in the codebook for $c_i$. This selection function is usually given as the error function $\epsilon_i$.

$$\varepsilon_i = \frac{(t_w^T \cdot Hc_i)^2}{\|Hc_i\|^2} \tag{1}$$

where $t_w^T$ is the transpose of $t_w$. The numerator of Equation (1) is the square of the cross-correlation of $t_w$ with the convolution of the impulse response H with the excitation vector $c_i$. In general, a selection function will be a function of the energy term $\|Hc_i\|^2$, which is the self-correlation of the convolution of the impulse response H with the excitation vector $c_i$. When the error function is used as the selection function, Equation (1) is evaluated for each excitation vector to determine the optimal $c_i$, and hence the desired index i. The vector quantity $Hc_i$ is the convolution of the impulse response of the weighted synthesis filter with the excitation vector $c_i$, and therefore represents the excited weighted synthesized speech segment $S_i$ as shown in FIG. 1, which is the output of the weighted synthesis filter. A measure of similarity of the excited weighted synthesized speech segment $S_i$ and the target speech sample $t_w$ is their cross-correlation, $t_w^T \cdot Hc_i$. This is a scalar quantity, and the higher its value, the closer the excited weighted synthesized speech segment $S_i$ is to the target speech sample $t_w$, and the better the excitation vector $c_i$ is for synthesizing the output speech sample. The numerator of the right-hand side expression in Equation (1) is the square of the cross-correlation of the excited weighted synthesized speech segment and the target speech sample. The denominator of the right-hand side expression in Equation (1) represents the energy term of the excited weighted synthesized speech segment $S_i$. Note that the convolution of H and $c_i$ is an important operation which appears in several places in the calculation of $\epsilon_i$.

Usually, CELP encoders utilize a pair of codebooks: an adaptive codebook and a fixed stochastic codebook. The excitation vectors of the fixed stochastic codebook are constant, whereas those of the adaptive codebook are updated by the encoder to accommodate the particular characteristics of the current target speech waveform. In analyzing a target speech waveform segment, an excitation vector is selected from each codebook. The two excitation vectors are combined in a weighted linear fashion and then sent as an input to the weighted synthesis filter. The procedure for selecting the optimum excitation vector as discussed above and illustrated in FIG. 1, and equivalently manifest in Equation (1), must be carried out for each of the codebooks.

Unfortunately, intensive numerical computation is needed to evaluate Equation (1), and so the processing required for codebook searching presents a major obstacle to improved CELP performance. Therefore, this is an area of interest in the field. For example, "Real-Time Vector Excitation Coding of Speech at 4800 BPS" by Davidson et al. (in *Proceedings of the IEEE International Conference on Acoustics, Speech, and Signal Processing (ICASSP)*, April, 1987, pages 2189–2192) explores issues as the use of small, optimized codebooks that are easier to search, and presents an approximation for the evaluation of the energy term as given in Equation (1) by an autocorrelation approach which requires reduced computation U.S. Pat. No. 5,265,190 discloses a method of simplifying the convolution computation in the cross-correlation terms for adaptive codebook searching. While improvements such as these have been useful in reducing the complexity of codebook searching, however, the computation is still intensive, and moreover does not address some of the specific needs of fixed stochastic codebook searching. For example. U.S. Pat. No. 5,265,190 does not disclose methods for fixed stochastic codebook searches, and, moreover, the method disclosed therein applies only to the cross-correlation term but not to the energy term.

Thus there is a recognized need for, and it would be advantageous to have, methods of further reducing the amount of processing needed to select the optimum excitation vector from a codebook, in particular for a CELP encoder that has both a fixed stochastic codebook as well as an adaptive codebook. The innovation of the present invention attains this goal for a certain class of CELP encoders with both an adaptive codebook and a fixed stochastic codebook. In addition, CELP techniques currently attain a very high degree of perceptual fidelity, and it is desired to retain this fidelity while making improvements to the CELP process itself. Therefore, a further goal realized by the present invention is the improvement of processing efficiencies without the introduction of any perceptible distortion or other degradation in the quality of the reconstructed speech.

SUMMARY OF THE INVENTION

It is possible to reduce amount of processing required to calculate values of $\epsilon$ in Equation (1) for a certain class of CELP encoders, specifically, those encoders for which there is a plurality of fixed stochastic codebook subframes corresponding to a single adaptive codebook subframe. The innovation of the present application applies to this particular class of CELP encoders, hereinafter denoted by the term "compacted codebook CELP encoders". The present application discloses a method whereby the processing required to calculate values of $\epsilon$ may be reduced by calculating energy terms and convolution terms only at the beginning of each adaptive codebook subframe and storing them in an adaptive energy lookup table.

Therefore, according to the present invention there is provided a compacted codebook CELP encoder having a weighted synthesis filter with an impulse response, an adaptive codebook, and a fixed stochastic codebook containing excitation vectors, such that a plurality of fixed stochastic codebook subframes corresponds to a single adaptive codebook subframe, the compacted codebook CELP encoder including an adaptive energy lookup table storing a plurality of values of at least one function of the convolution of the impulse response of the weighted synthesis filter with the excitation vectors of the fixed stochastic codebook.

Furthermore according to the present invention there are provided additional methods using linear interpolation to reduce the amount of computation necessary to calculate the values for the adaptive energy lookup table. In this method the values of $Hc_i$ are calculated only once per adaptive codebook subframe, and the values for the adaptive codebook subframes are derived by interpolating the calculated values according to a linear formula.

In addition the present invention discloses a simplified method of calculating the cross-correlation terms for a fixed stochastic codebook which involves a de-convolution operation instead of a convolution operation. Once the de-convolution is done, it requires only vector multiplication instead of matrix multiplication to calculate the cross-correlation, thereby simplifying the computations.

BRIEF DESCRIPTION OF THE DRAWINGS

The invention is herein described, by way of example only, with reference to the accompanying drawings, wherein:

FIG. 4 illustrates a reduced adaptive energy lookup table for a compacted codebook CELP encoder.

DESCRIPTION OF THE PREFERRED EMBODIMENTS

The present invention is of a method for reducing the computation needed to select the optimum excitation vector from the fixed stochastic codebook of a compacted codebook CELP encoder. The optimum excitation vector is the one having the maximum normalized cross-correlation with a weighted target speech sample, as given in Equation (1). The cross-correlation is normalized by dividing it by the energy term.

There is a property of compacted codebook CELP encoders which is useful in reducing the computation required to search the fixed stochastic codebook. In addition to the variability of the adaptive codebook excitation vectors versus the static nature of the fixed stochastic codebook excitation vectors, the fixed stochastic codebook for this class of CELP encoders has a smaller subframe than that of the adaptive codebook. An adaptive codebook subframe is sometimes referred to as a "pitch subframe," and a fixed stochastic codebook subframe is sometimes referred to as a "codebook subframe," but for clarity, the present application will use the terms "adaptive codebook subframe" and "fixed stochastic codebook subframe," respectively. As an example of typical sampling practices, an adaptive codebook subframe may contain 40 samples (representing 5 msec of speech at a sampling rate of 8 KHz), whereas the fixed stochastic codebook subframe may contain only 10 samples (representing 1.25 msec of speech at a sampling rate of 8 KHz). Recall that for compacted codebook CELP encoders, there is a plurality of fixed stochastic codebook subframes corresponding to a single adaptive codebook subframe. The present innovation makes use of this to reduce the real-time processing requirements in selecting the optimum excitation vector from the fixed stochastic codebook.

Figure 1:
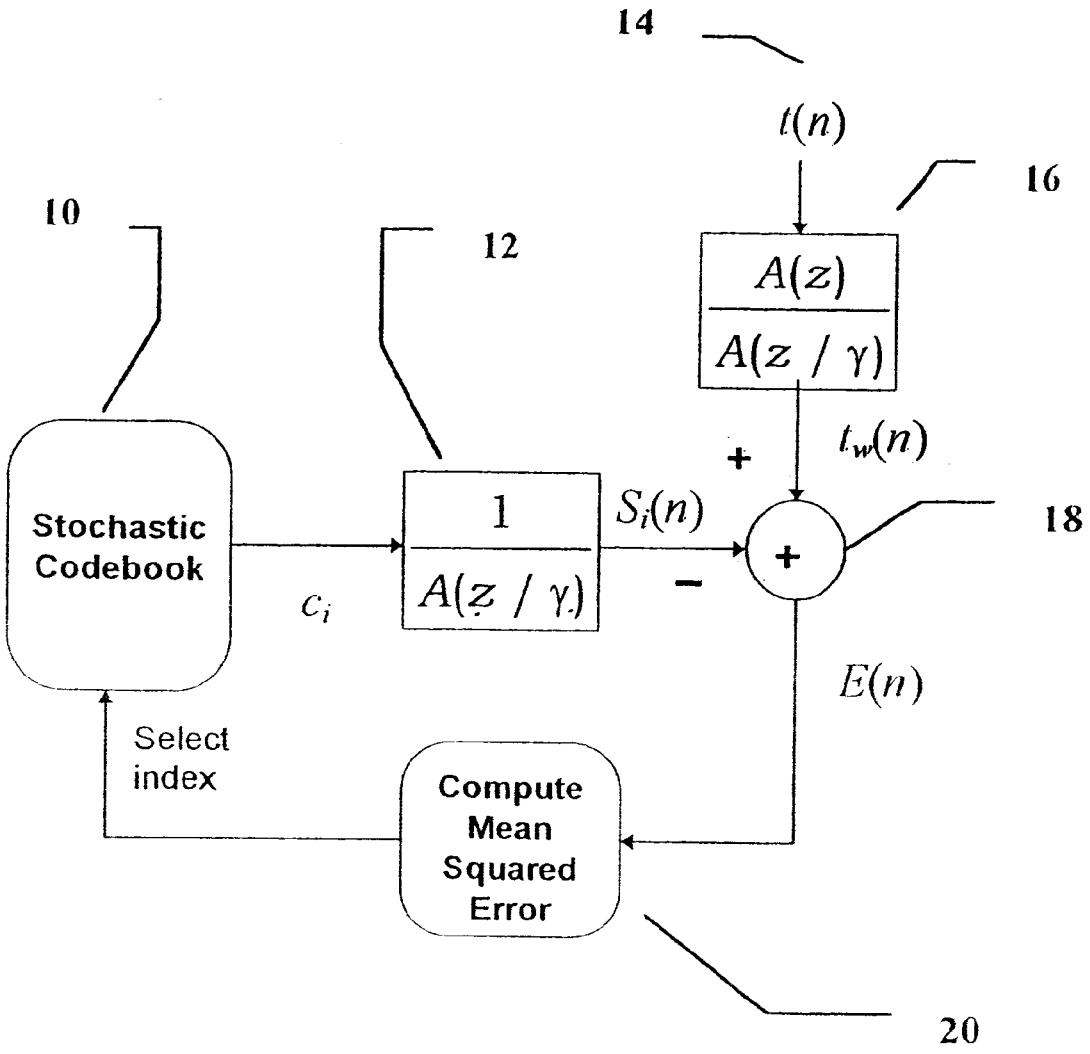
FIG. 1. (PRIOR ART)
FIG. 1 is a flowchart showing the prior art procedure to search for the optimum excitation vector in a stochastic codebook for a given target speech sample.

Referring once again to FIG. 1, which illustrates conceptually how the optimum excitation vector is selected, target speech sample 14 t(n) is processed by weighting filter 16 which is a function of the LPC, to yield a weighted target speech sample $t_w(n)$. Each excitation vector $c_i$ of codebook 10 is processed by weighted synthesis filter 12 to result in a weighted synthesized speech segment $S_i(n)$, which is compared against the weighted target speech sample by comparator 18, whose output is the difference $t_w(n)-S_i(n)$, which is the error vector E(n). Error computation 20 computes the mean squared error over the error vector for each codebook index i. The index i whose $c_i$ has minimal mean squared error is the selected index.

Figures 2, 3:
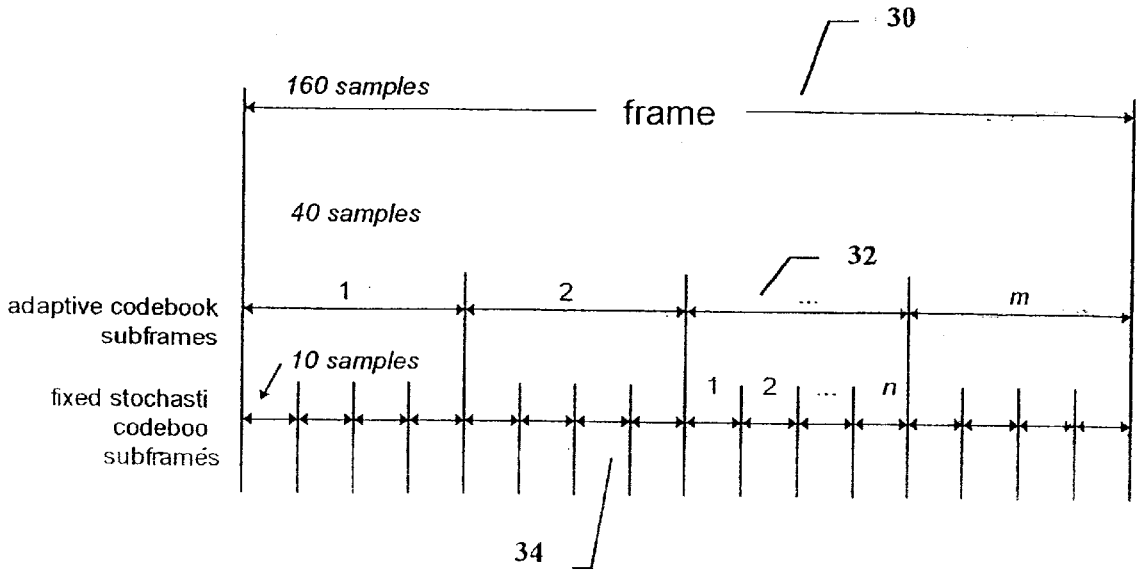
FIG. 2. (PRIOR ART)
FIG. 2 illustrates an example of the relationship between prior art frames, adaptive codebook subframes, and fixed stochastic codebook subframes for compacted codebook CELP encoder.
FIG. 3 illustrates an adaptive energy lookup table for a compacted codebook CELP encoder.

For a compacted codebook CELP encoder, let m represent the number of adaptive codebook subframes in each frame, and let n represent the number of fixed stochastic codebook subframes corresponding to a single adaptive codebook subframe. FIG. 2. to which reference is now made, shows this situation for an example of a prior art compacted codebook CELP encoder in which a frame 30 consists of 160 samples, an adaptive codebook subframe 32 consists of 40 samples, and a fixed stochastic codebook subframe 34 consists of 10 samples. In this example, there are therefore m=4 adaptive codebook subframes in each frame, and n=4 fixed stochastic codebook subframes corresponding to ever single fixed stochastic codebook subframe.

For a compacted codebook CELP encoder, it is noted that the LPC's are updated for each adaptive codebook subframe 34, and the selected excitation vector $c_i$ changes for each fixed stochastic codebook subframe 34. The impulse response matrix H, however, changes only every adaptive codebook subframe 32. Therefore, since the fixed stochastic codebook itself (the set of excitation vectors $c_i$) is constant, the set of possible terms in the denominator of the right-hand side of Equation (1). $Hc_i$, will be constant for any given adaptive codebook subframe 32, and is therefore constant over n fixed stochastic codebook subframes 34. To exploit this fact, the present invention innovates an adaptive energy lookup table associated with the impulse response of a weighted synthesis filter and the excitation vectors of a fixed stochastic codebook. This association is such that the adaptive energy lookup table stores the N values of at least one function of the convolution $Hc_i$ and the energy term $\|Hc_i\|^2$ applicable to each adaptive codebook subframe 32, and these values may be used to evaluate a function which determines the selection of the optimum excitation vector from the fixed stochastic codebook for the n corresponding fixed stochastic codebook subframes 34. An example of such a function is the function $\epsilon_i$ in Equation (1). Note that an adaptive energy lookup table will be associated with the impulse response of a particular weighted synthesis filter and the excitation vectors of a particular fixed stochastic codebook. Through the use of the adaptive energy lookup table, the set of energy terms for substitution into the denominator of the right-hand side of Equation (1) and the set of convolution terms for evaluating the cross-correlation in the numerator of the right-hand side of Equation (1) need be computed only m times per frame, rather than mn times per frame, thereby reducing the computation needed.

In a preferred embodiment of the present invention, an adaptive energy lookup table contains N entries, each entry corresponding to exactly one of the excitation vectors $c_i$ in the fixed stochastic codebook, and having the same index i. Each $c_i$ is convolved with H to yield $Hc_i$, and this is used to calculate the value $\|Hc_i\|^2$. These are placed into the adaptive energy lookup table at index i. This is illustrated conceptually in FIG. 3. Column 40 of the table contains the index i. Column 42 contains the convolution $Hc_i$ corresponding to the index i, and column 44 contains the energy term values $\|Hc_i\|^2$ corresponding to index i. Note that the convolution Hci is a vector, whereas the energy $\|Hc_i\|^2$ is a scalar quantity. Furthermore, note that the convolution $Hc_i$ is a by-product of calculating the energy term $\|Hc_i\|^2$. To use this embodiment of the present invention to calculate a selection function such as $\epsilon_i$ as in Equation (1), it is necessary to retrieve the convolution vector $Hc_i$ from the adaptive energy lookup table and multiply it by the transpose of the target speech sample $t_w^T$ to obtain the cross-correlation. This value is then squared and normalized by dividing it by the energy term $\|Hc_i\|^2$ from the adaptive energy lookup table to obtain $\epsilon_i$.

In another embodiment of the present invention, an adaptive energy lookup table may be reduced to contain only a single column of values related to both the convolution and the energy terms. This is illustrated conceptually in FIG. 4 column 40 contains the index i, as in FIG. 3. In this particular embodiment, column 46 contains the normalized convolution terms, which are the vectors $Hc_i$ divided by the energy term $\|Hc_i\|^2$. Such a reduced adaptive energy lookup table cannot be used to calculate values of $\epsilon_i$ as given in Equation (1), because the normalization is applied directly to the convolution prior to calculating the cross-correlation. However, a reduced adaptive energy lookup table can be used to calculate other functions which can serve as measure of the suitability of an excitation vector $c_i$ in synthesizing reconstructed speech, such that selecting $c_i$ based on a maximum of such a function approximates the $c_i$ based on a maximum of $\epsilon_i$. For example, the reduced adaptive energy lookup table can be used to calculate a selection function of the form:

$$\phi_i = \frac{(t_w^T \cdot Hc_i)^2}{\|Hc_i\|^4} \tag{2}$$

where the maximum $\phi_i$ serves to identify the optimum excitation vector $c_i$. The selection function of Equation (2) will not select precisely the same $c_i$ as that of Equation (1), because the denominator is $\|Hc_i\|^4$ instead of $\|Hc_i\|^2$. If, however, the excitation vectors are selected such that $\|Hc_i\|^2$ does not vary significantly over the fixed stochastic codebook for typical impulse response matrices H, then this function will select $c_i$'s which perceptually approximate those which would be selected by Equation (1).

The adaptive energy lookup tables are illustrated in FIG. 3 and FIG. 4 only conceptually. In practice, since the tables are normally to be implemented in data memory, it is not necessary to store the index i explicitly, such as in a column 40, as the index can be implicit in the address locations of the entries relative to the starting locations of the tables.

From a consideration of the embodiments discussed above it will be appreciated that many variations of the adaptive energy lookup table are possible. As discussed above, for example, other functions besides $\epsilon_i$ as in Equation (1) are possible, for use in selecting the optimum excitation vector. Therefore, an adaptive energy lookup table in its most general form stores values of at least one specified function of the convolution $Hc_i$ corresponding to the excitation vectors $c_i$ of the fixed stochastic codebook.

Figure 5:
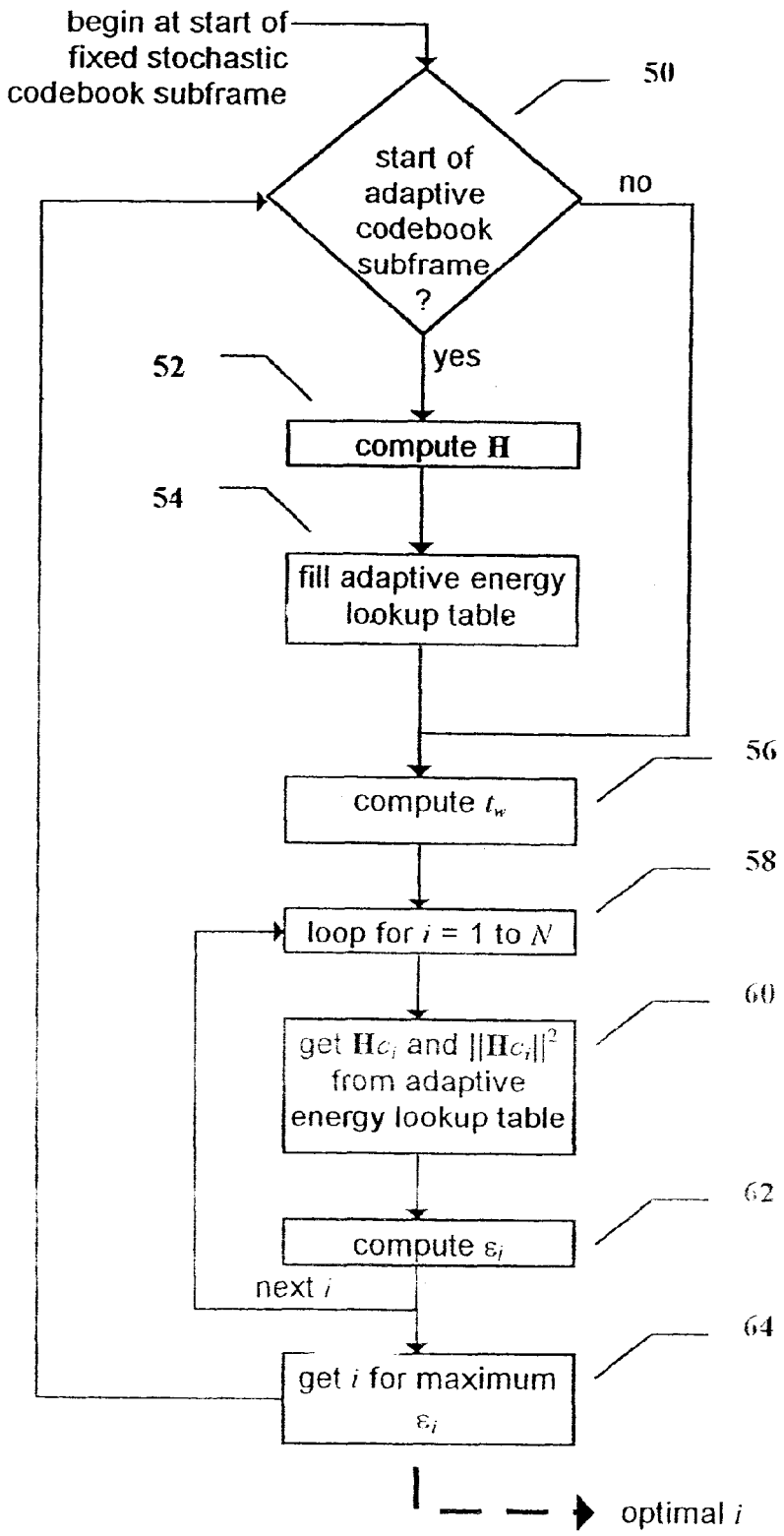
FIG. 5 is a flowchart illustrating conceptually how the adaptive energy lookup table is used to select the optimum excitation vector from a fixed stochastic codebook.

FIG. 5 illustrates conceptually how the adaptive energy lookup table is used in the selection of the index i corresponding to the optimum excitation vector $c_i$. The procedure of FIG. 5 commences at the start of a fixed stochastic codebook subframe and determines the index i corresponding to the optimum excitation vector $c_i$ for that fixed stochastic codebook subframe and for each following fixed stochastic codebook subframe. Decision point 50 first determines whether it is necessary to load the adaptive energy lookup table with new values, depending on whether the encoder is also at the start of an adaptive codebook subframe. Note that decision point 50 is reached at the start of every fixed stochastic codebook subframe. Refer to FIG. 2, which illustrates the relationships between frames, adaptive codebook subframes, and fixed stochastic codebook subframes for a compacted codebook CELP encoder. It is seen that the start of every adaptive codebook subframe coincides with the start of a fixed stochastic codebook subframe, but not every fixed stochastic codebook subframe coincides with the start of an adaptive codebook subframe. If the encoder is at the start of an adaptive codebook subframe, step 52 computes the impulse response matrix H, and step 54 fills the adaptive energy lookup table with values for each index i. If, however, the encoder is not at the start of an adaptive codebook subframe, step 52 and step 54 are skipped. In either case, the adaptive energy lookup table will have a complete set of applicable cross-correlation terms and energy terms for the excitation vectors of the fixed stochastic codebook for the current fixed stochastic codebook subframe. Next, step 56 is performed to calculate the transpose of the weighted target speech sample, $t_w^T$. An iterative loop 58 goes through the adaptive energy lookup table and retrieves values of $Hc_i$ and $\|Hc_i\|^2$ in step 60, and then uses them to calculate $\epsilon_i$ by evaluating, Equation (1) in step 62. When iterative loop 58 is complete, the maximum $\epsilon_i$ is determined and the optimal index i is output in step 64.

The flowchart of FIG. 5 presents the procedure conceptually, and in practice it may be implemented in a number of different ways with variations. For example, it might be more efficient to store $Hc_i$ and $\|Hc_i\|^2$ into the adaptive energy lookup table as a by-product of the first iteration of iterative loop 58 when calculating the $\epsilon_i$'s, rather than to compute them, store them, and then have to retrieve them again, in the order conceptually illustrated by FIG. 5. Likewise, efficiency would be improved by incorporating step 64, which finds the maximum $\epsilon_i$, directly into iterative loop 58 rather than to search for the maximum subsequent to the execution of iterative loop 64, in the order conceptually illustrated by FIG. 5. To find the maximum $\epsilon_i$ outside iterative loop 58 would require storing all the values of $\epsilon_i$ in a separate table and then iterating through that table looking for the maximum. Various techniques for optimizing such calculations are well-known in the art.

In a preferred embodiment of the present invention, further savings in computation may be realized by applying linear interpolation in the computation of the convolution $Hc_i$. Let the current frame be represented by the subscript j and the number of the current adaptive codebook subframe be represented by the integer k, such that $1 \leqq k \leqq m$. Then the values of $Hc_i$ for the adaptive energy lookup table corresponding to the adaptive codebook subframe are given by:

$$Hc_i = \frac{m-k}{m}\{Hc_i\}_{j-1} + \frac{k}{m}\{Hc_i\}_j \tag{3}$$

That is, the values of $Hc_i$ for an adaptive codebook subframe are weighted sums of the values calculated for the previous frame, denoted by $\{Hc_i\}_{j-1}$ and those calculated for the current frame, denoted by $\{Hc_i\}_j$. In this case, for example, the weighted sums are linear combinations as depicted in Equation (3). Once again, since the fixed stochastic codebook (the set of excitation vectors $c_i$) is constant, only H will change from one adaptive codebook subframe to another. Therefore, when interpolation according to Equation (3) is performed, the computation of $\{Hc_i\}$ need be done only once per frame instead of m times per frame. The adaptive energy lookup table containing the values of $\|Hc_2\|^2$ can thus be updated with minimal computation for most of the fixed stochastic codebook subframes. Linear interpolation does not provide complete accuracy in calculating the convolutions, but the results are within approximately 98% of the correct values. The inaccuracy of linear interpolation is imperceptible to the human ear.

In another embodiment of the present invention, a transformation is made in the computation of the cross-correlation when searching for the optimum fixed stochastic codebook excitation vector. The cross-correlation is represented in the numerator in the right-hand side of Equation (1):

$$\text{cross-correlation} = t_w^T \cdot Hc_i \tag{4}$$

Referring again briefly to FIG. 1, it can be seen that the term $Hc_i$ is a vector which corresponds to the physical filtering of $c_i$ to yield the output weighted synthesized speech segment $S_i$ from weighted synthesis filter 12. The cross-correlation is the vector dot product of the filtered target speech sample with $S_i$. Calculating this for each $c_i$ in the fixed stochastic codebook requires a matrix multiplication for each $c_i$ to obtain $S_i = Hc_i$, and then a vector multiplication, $t_w^T \cdot S_i$, to obtain the cross-correlation. This set of operations must be repeated for each fixed stochastic codebook subframe. If, on the other hand, Equation (4) is written as:

$$\text{cross-correlation} = t_w^T H \cdot c_i \tag{5}$$

then only a vector multiplication, instead of a matrix multiplication, is needed for each $c_i$ to obtain the cross-correlation. A matrix multiplication to calculate the transpose vector $t_w^T H$ need be done only once per fixed stochastic codebook subframe, instead of N times per fixed stochastic codebook subframe, resulting in a net savings of N−1 matrix multiplications per fixed stochastic codebook subframe. The transpose vector resulting from the operation $t_w^T H$ is an innovative artifice to reduce the complexity of the calculations for the fixed stochastic codebook. The present application uses the term "transpose convolution" to denote the transpose of a vector multiplied by the matrix representing an impulse response; an example of a transpose convolution is the transpose vector $t_w^T H$.

While the invention has been described with respect to a limited number of embodiments, it will be appreciated that variations and modifications of the invention may be made.

What is claimed is:

1. A compacted codebook CELP encoder for compressing speech, the compacted codebook CELP encoder having a weighted synthesis filter with an impulse response, an adaptive codebook, and a fixed stochastic codebook containing excitation vectors, such that a plurality of fixed stochastic codebook subframes corresponds to a single adaptive codebook subframe, the compacted codebook CELP encoder comprising an adaptive energy lookup table storing a plurality of values of at least one function of the convolution of the impulse response with the excitation vectors wherein said adaptive energy lookup table stores a plurality of values of energy terms corresponding to the excitation vectors, said adaptive energy lookup table facilitating the selection of excitation vectors.

2. A method for selecting an excitation vector from a fixed stochastic codebook of a compacted codebook CELP encoder having an adaptive codebook such that a plurality of fixed stochastic codebook subframes corresponds to a single adaptive codebook subframe and such that a plurality of adaptive codebook subframes corresponds to a single frame of the compacted codebook CELP encoder, wherein the fixed stochastic codebook contains a plurality of excitation vectors for input into a weighted synthesis filter having an impulse response, the method comprising the steps of:

(a) providing a selection function of a weighted target speech sample and an excitation vector, the values of said function determining the excitation vector to be selected from the fixed stochastic codebook;

(b) providing an adaptive energy lookup table having entries containing a plurality of values of at least one function of a convolution of the impulse response with an excitation vector; and (c) performing an evaluation of said selection function for each excitation vector of the plurality of excitation vectors, said evaluation being based on said entries in said adaptive energy lookup table.

3. The method as in claim 2, further comprising the steps of:

(d) calculating said convolution of the impulse response with each of the excitation vectors of the plurality of excitation vectors;

(e) calculating the values of said at least one function of said convolution with each of the excitation vectors of the plurality of excitation vectors; and (f) storing said values in said entries of said adaptive energy lookup table.

4. The method as in claim 3, wherein the values of said convolution are known for two consecutive frames of the compacted codebook CELP encoder, the method further comprising the step of:

(g) calculating said convolution for an adaptive codebook subframe as a weighted sum of the values of said convolution for the two consecutive frames of the compacted codebook CELP encoder.

5. The method as in claim 2 wherein said selection function is a function of the cross-correlation of said weighted target speech sample and said convolution, the method further comprising the steps of:

(d) calculating a product, said product being equal to the transpose of said weighted target speech sample multiplied by the impulse response; and (e) multiplying said product by each of the excitation vectors of the plurality of excitation vectors.

6. The method as in claim 2, wherein said selection function is the error function.

7. The method as in claim 6, wherein calculating said error function further comprises the steps of:

(d) calculating a cross-correlation, said cross-correlation being equal to the transpose of said weighted target speech sample multiplied by the convolution of the impulse response with the excitation vector;

(e) calculating the square of said cross-correlation;

(f) obtaining an energy term, said energy term being equal to the self-correlation of the convolution of the impulse response with the excitation vector; and (g) calculating a quotient, said quotient being equal to the square of said cross-correlation divided by said energy term.

8. The method as in claim 6, wherein calculating said error function further comprises the steps of:

(d) calculating a transpose convolution of said weighted target speech sample with the impulse response;

(e) calculating a cross-correlation, said cross-correlation being equal to said transpose convolution multiplied by the excitation vector;

(f) calculating the square of said cross-correlation;

(g) obtaining an energy term, said energy term being equal to the self-correlation of the convolution of the impulse response with the excitation vector; and (h) calculating a quotient, said quotient being equal to the square of said cross-correlation divided by said energy term.

9. An improved CELP encoder for compressing speech, the CELP encoder having a weighted synthesis filter, an adaptive codebook, and a fixed stochastic codebook containing excitation vectors, wherein the improvement comprises an adaptive energy lookup table storing a plurality of values of at least one function of the convolution of the impulse response with the excitation vectors and wherein said adaptive energy lookup table stores a plurality of values of energy terms corresponding to the excitation vectors, said adaptive energy lookup table facilitating the selection of excitation vectors.

* * * * *